US007973657B2

(12) United States Patent
Ayed

(10) Patent No.: US 7,973,657 B2
(45) Date of Patent: Jul. 5, 2011

(54) SYSTEMS FOR MONITORING PROXIMITY TO PREVENT LOSS OR TO ASSIST RECOVERY

(76) Inventor: Mourad Ben Ayed, Menlo Park, CA (US)

( * ) Notice: Subject to any disclaimer, the term of this patent is extended or adjusted under 35 U.S.C. 154(b) by 473 days.

(21) Appl. No.: 12/132,463

(22) Filed: Jun. 3, 2008

(65) Prior Publication Data

US 2009/0207013 A1 Aug. 20, 2009

Related U.S. Application Data

(63) Continuation-in-part of application No. 12/034,102, filed on Feb. 20, 2008, now abandoned.

(51) Int. Cl.
*G08B 1/08* (2006.01)

(52) U.S. Cl. ..... 340/539.23; 340/539.11; 340/573.1; 455/41.2; 455/426.1; 455/550.1

(58) Field of Classification Search ..... 340/10.1, 340/573.1, 573.4, 686.6, 539.1–539.32; 455/418, 455/419, 41.2, 426.1, 550.1
See application file for complete search history.

(56) References Cited

U.S. PATENT DOCUMENTS

| | | | | |
|---|---|---|---|---|
| 6,885,848 | B2 * | 4/2005 | Lee | 455/41.2 |
| 7,565,132 | B2 * | 7/2009 | Ben Ayed | 455/404.1 |
| 2002/0080036 | A1 * | 6/2002 | Rabanne et al. | 340/573.1 |
| 2003/0137414 | A1 * | 7/2003 | Chen | 340/539.1 |
| 2005/0280546 | A1 * | 12/2005 | Ganley et al. | 340/573.4 |
| 2007/0224980 | A1 * | 9/2007 | Wakefield | 455/418 |

* cited by examiner

*Primary Examiner* — Brent Swarthout
(74) *Attorney, Agent, or Firm* — Daniel Schein, Esq.

(57) ABSTRACT

A portable proximity alarm apparatus comprising a Bluetooth system and an alarm monitors the presence of a portable electronic device equipped with a compatible transceiver within range and alarms when that device leaves its range. On detecting disconnection, the proximity alarm automatically tries to reconnect. A portable proximity alarm apparatus with an optional voice mode allows to additionally use the unit as a headset when an earpiece is folded. A portable proximity alarm apparatus with relay functionality allows using a Bluetooth headset and proximity alarm functions unobtrusively on most mobile phones.

6 Claims, 14 Drawing Sheets

SYSTEMS FOR MONITORING PROXIMITY TO PREVENT LOSS OR TO ASSIST RECOVERY

PRIORITY

The present application is a Continuation-In-Part ("CIP") of pending U.S. patent application Ser. No. 12/034,102 now abandoned, filed Feb. 20, 2008.

FIELD OF THE INVENTION

The present inventions relate to devices that detect and/or prevent loss via proximity detection system alarms, and more specifically relates to devices that monitor the presence of at least one wireless communication device and that issue an alarm when said device is not within a desired proximity.

BACKGROUND

Portable electronic devices such as cellular telephones, personal digital assistants (PDAs), wireless email devices, instant messaging devices, pagers, portable compact disk (CD) players, portable MP3 players, and others are often forgotten, lost, or stolen (a "PED" includes any portable device that can be used for communication, performing intellectual and/or physical work, and/or entertainment). Existing wireless device loss detection approaches focus primarily on remotely accessing a device after it is lost. This allows prohibiting the device, such as a cell phone, from placing phone calls. It also allows hiding the device owner's information or erasure of sensitive data. This strategy aims to increase the user's chances of recovering the device and to protect data stored in the device. This method does not allow users to quickly recover their lost devices. Other methods for tracking and locating a lost cell phone include network triangulation and GPS interrogation. These methods do not allow users to automatically and/or instantaneously recover their lost devices. Another method and apparatus for reducing the likelihood of losing a portable electronic device is disclosed in U.S. Pat. No. 6,836,212, and in U.S. Pat. No.7,005,999, which monitors inadvertent removal of a portable electronic device (PED) from its retaining device. So, if the PED is already removed from its retaining device for use or the retaining device and PED are left behind together or move out of a desired range, this apparatus does not protect users from losing their PEDS.

U.S. Patent application publication 20050280546 discloses two mobile transceivers that are linked through a Bluetooth link. The Bluetooth enabled RF link between the first and second mobile transceiver units forms a monitoring piconet. The second mobile transceiver unit provides an alarm indication when the first mobile transceiver unit moves beyond a distance of approximately ten meters from the second mobile transceiver unit. The second device repeatedly pages the first device, and waits for a response. If a response is not received, an alarm is issued. This system is unreliable and unfit for use as a proximity alarm because paging consumes 40 mA, a rate that would inconvenience the user by requiring an expensive and/or heavy battery or frequent recharging. Further, paging is often blocked by human bodies, which can result in false alarms when a page does not reach the first device. Nevertheless, a Bluetooth based communication system has many benefits over traditional analog systems, including greater security and the ease of designing and building transceiver systems using Bluetooth. Due to the widespread acceptance and use of the Bluetooth standard, circuitry for Bluetooth systems has been built into small, lightweight chips, which are readily available at low cost.

U.S. Pat. No. 6,885,848 is directed to an apparatus for preventing the loss of a portable telephone that uses Bluetooth communication protocol. The signal strength is periodically monitored and an alarm issued to the headphone when the signal is below a threshold. Bluetooth protocol provides for a received signal strength indicator (RSSI) value or the Link Quality value to be determined at any time. If the value received is below a threshold, an alarm is issued to the headphone. This system and method have been tested, and not found to a reliable way for indicating that a mobile phone has left a proximity range due to production of false positives. Further, the system requires that the headphone be proximate an ear for the alarm to be detected.

U.S. Patent application publication 20020080036 discloses the use of a mobile network for tracking the position of a plurality of objects and displaying them on a map; the apparatus in this patent requires expensive transceivers, and has a significant time delay for indicating object is out of range.

U.S. Pat. No. 6,989,748 discloses a battery with an integrated tracking device. The system is difficult to commercialize because of the large variety of batteries on the market. Furthermore, the transmitter/receiver system needs an antenna, and it would be a challenge to install an antenna inside the battery or on its surface as that would compromise its performance.

U.S. Pat. No. 7,002,473 discloses a loss prevention system that uses RFID. It requires a bulky transceiver that interrogates all the RFID tags. It is not convenient for portable applications inter alia.

U.S. Pat. No. 5,796,338 discloses a system and method for preventing loss of a cellular phone or similar portable device. The system includes a wireless transmitter in cell phones for intermittently sending security signals to a pager worn by the user. An alarm is actuated when the strength of the security signal falls below a predetermined threshold. This system cannot be used with existing phones and requires cell phone manufacturers to modify their designs.

In general, there exists a need for technologies that enable one to know that certain persons, animals or things (e.g., mobile phones, and computers) stay within a desired proximity of a specified area. For example, a parent in a shopping mall may want their child to stay within a certain proximity of the parent and may wish to remotely monitor the child's activities; should the child go beyond the desired proximity it is desired that a clear notice be given (e.g., alarm requiring acknowledgement) and perhaps even communicate with the child. Another example is that a parent walking in a park may want their walking child to stay within a certain range. Or a person walking their dog wants it to stay within a certain range. With respect to things, people generally want their mobile phone and/or portable computers or other PEDs to stay within a certain range to avoid loss thereof and/or unauthorized access or to have them at hand for use.

In order to solve these problems, there is a need for technologies that are simple to use, inexpensive to build and use, small and light weight enough to be mobile, adaptable for different situations, and secure.

However, such an analog RF system is capable of being undermined by other interfering devices. While the manufacturer may vary the signal frequency used by different pairs of transmitters and receivers, it is possible for a receiver in a first pair to detect a transmitter from a second pair, thus risking the possibility that the first receiver would not detect the first transmitter going out of range, which could not only mean that a child being monitored goes out of range without an alarm but that the parents would have a false sense of security that the child was within range and so consequently they do not look after the child as much they may otherwise have without the system. This derives from the system being designed to work at a common pre-set frequency between the transmitter and receiver, and the receiver cannot discriminate between different transmitters transmitting at substantially the same frequency. Further, when a transmitter or receiver is lost, it is not likely that a replacement can be readily obtained that has a matching fixed frequency transmission or reception range, despite the possibility of an interfering transmitter being encountered at random in use. The lack of security on these RF type transmitter receiver pairs means that a child or pet abductor can monitor the frequency of a first transmitter and program a second transmitter that can be used as a decoy to defeat the system. While an analog transmitter and receiver can be preset to be a pair, i.e., one can receive the signal of the other automatically when within range, this should not be confused with the process of pairing of two digital devices that also use RF type communication. For example, Bluetooth headset devices are available that pair with a mobile phone. A Bluetooth headset can provide a tone to the ear of a wearer when the Bluetooth connection to the mobile phone is dropped. However, one must be generally within about 3 feet of the headset to hear the tone if the mobile phone is moved out of range of the headset.

Thus, a need exists for systems for monitoring persons, things, and animals that are reliable, simple to use, cost effective, mobile, adaptable and secure. Such systems should provide an alarm to users upon detecting that a person, animal or thing is not within a desired proximity, wherein the alarm is appropriate to the circumstances. Further, there is also a need for more proactive systems to reduce the risk of loss of a person, animal or thing, and to make such systems ubiquitous as standard accessories.

SUMMARY OF THE INVENTION

A proximity detection alarm device, comprising a first unit, said first unit comprising a first Bluetooth transceiver system; at least one alarm; at least one control; a power input; an attachment mechanism and wherein said first Bluetooth transceiver system can pair with a second Bluetooth transceiver system in a first range, wherein said attachment mechanism is selected from the group consisting of a key chain, a ring, a hook, a notebook security lock, an insert, a pin, a clip, a tee, a collar, Velcro fastener, a ring, and a sticky surface, wherein said Bluetooth transceiver system is selected from the group consisting of a class 1 Bluetooth transceiver, a class 2 Bluetooth transceiver, a class 3 Bluetooth transceiver, and a Wibree transceiver, wherein said at least one control comprises at least one of the group consisting of a button, a switch, and a sensor, wherein said at least one alarm is audible and when activated produces an alarm signal of at least 60 decibels, wherein following pairing with a second Bluetooth transceiver system, said first Bluetooth transceiver system will utilize a power saving mode selected from the group consisting of sniff, park, and hold, wherein upon said first Bluetooth transceiver detecting a connection drop from a second Bluetooth transceiver system to which said first Bluetooth system has formed a pair, said first Bluetooth transceiver system will periodically attempt to reconnect to the second Bluetooth transceiver system, wherein said alarm will be activated within a predetermined time after a connection drop between said first Bluetooth transceiver system and a second Bluetooth transceiver system to which said first Bluetooth system has formed a pair. In an embodiment, the alarm will not be activated if a pair is formed again before a predetermined time has elapsed after a connection drop.

A method for securing a portable electronic device comprising:

running a client software on a portable electronic device, wherein upon said client detecting a connection drop from a first Bluetooth transceiver system to which said client has formed a pair, said client will periodically attempt to reconnect to the first Bluetooth transceiver system, wherein said client issues an alert within a predetermined time after a connection drop between said client and said first Bluetooth transceiver system to which said client has formed a pair. In another embodiment, a proximity detection alarm device, comprising: a first unit, said first unit comprising a first Bluetooth transceiver system; at least one control; a power input; a microphone; an ear piece; a bearing joining said ear piece to the main body of said first unit; wherein said ear piece can fold and unfold.

BRIEF DESCRIPTION OF THE FIGURES

The present inventions may be more clearly understood by referring to the following figures and further details of the inventions that follow.

Similar reference numerals are used in different figures to denote similar components.

FURTHER DETAILS OF THE INVENTIONS

Figure 1A:
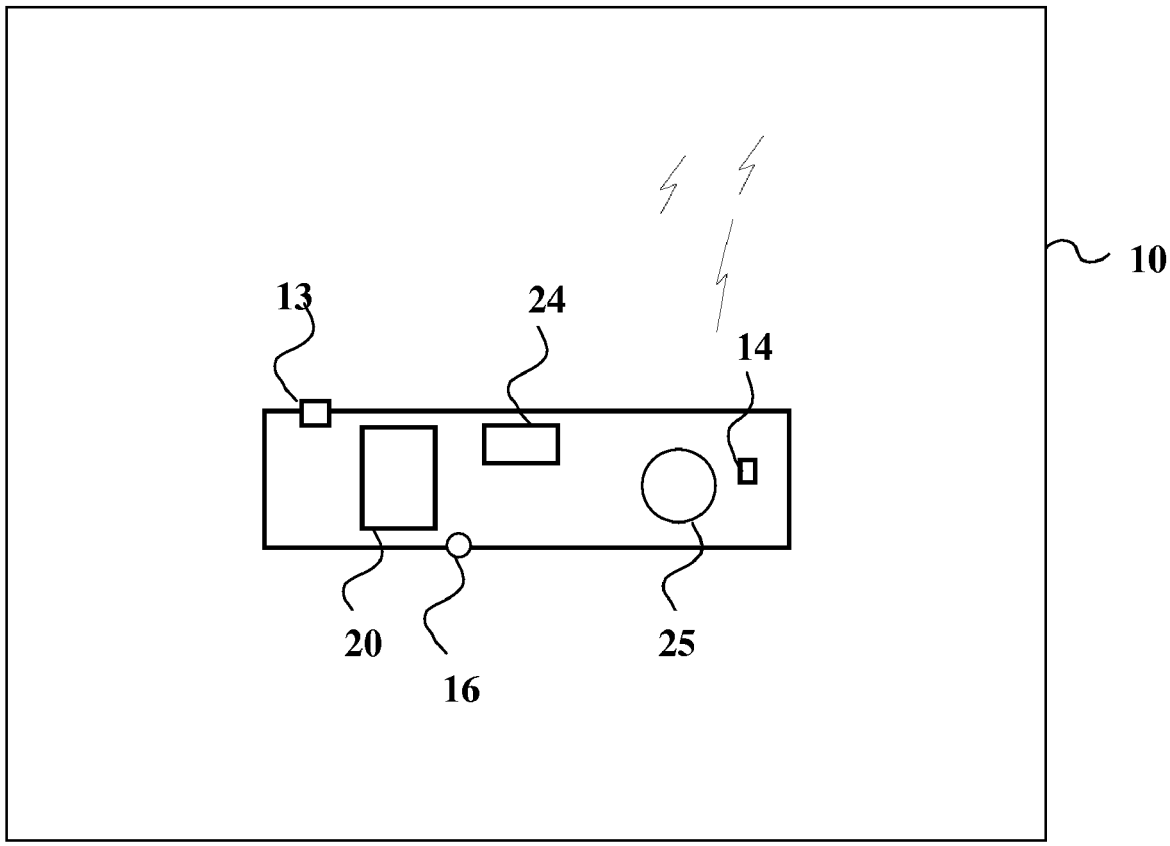
FIG. 1A is a schematic of a portable loss prevention alarm.

The following provides further details of the present inventions summarized above and illustrated in a schematic fashion in the Figures. In accordance with a first aspect of the present inventions, FIG. 1A is a schematic illustration of a portable loss prevention alarm 10 comprising a Bluetooth system 20 operatively connected with at least one activation switch 13, a visual indication center (or display) 16, a power store 24, an alarm center 25 and an antenna 14. Display 16 can be used to indicate the status of the device, such as whether it is powered, if the Bluetooth transceiver system (BT) is discoverable or non-discoverable, if the BT is pairing or paired with another BT, the BT mode, inter alia.

In a preferred embodiment, the components of the portable loss prevention alarm 10 can fit in a volume less about 60×30×10 mm or 18 cc, so that alarm 10 can fit into a housing having an interior with dimensions of 60×30×10 mm or no more than 18 cc. In another embodiment, alarm 10 can fit into a volume 10 cc, and weigh about 50 grams or less, and preferably less than about 10 g. Devices of the present invention should take up minimal volume and be light weight. For example, each device of the present inventions will preferably fit into a space having a volume of 56 cubic centimeters, 25 cubic centimeters, 22.5 cubic centimeters, 18 cubic centimeters, 10 cubic centimeters, or 1 cubic centimeters, and each device of the present inventions preferably has a weight less than about 200 grams, less than about 50 grams, or less than about 10 grams.

An attachment mechanism or system, including but not limited to a hook, harness, notebook security lock, insert, pin, clip, badge, clip, key chain, ring, tee, dog collar, Velcro, ring, fastening mechanism, sticky surface are optionally attached to the loss prevention alarm 10.

Control or activation switches 13 can be any type of button, switch, remote sensor, touch sensor, contact sensor or activation system. Activation switches 13 are used to turn the loss prevention alarm ON/OFF, to shut off the alarm, to change the Bluetooth system mode to pairing mode, and/or to start voice transmission for embodiments that have a microphone and/or speaker. For example, a single control button can cycle through a menu of functions by changing the length of time that the button is held and/or the speed with which a first press is followed by a second press (analogous to the single and double click on a computer mouse). One or two control buttons coupled with a simple display screen can adjust a variety of operational parameters.

Bluetooth system 20 enables connectivity over the 2.4 GHz radio frequency (RF) band. Bluetooth system 20 includes a radio and base band IC for Bluetooth 2.4 GHz systems. In a preferred embodiment, Bluetooth system 20 includes ROM, Flash memory or external memory or any other type of memory. In an alternative embodiment, Bluetooth system 20 includes a power amplifier (PA) and/or low noise amplifier (LNA) for increasing the Bluetooth transmission range.

In a preferred embodiment, Bluetooth system 20 includes a processor, RAM and Flash for loading and executing program. The processor executes the Bluetooth protocol, as well as the program that provides the proximity detection and alarming functionality. The processor can also executes other functionality such as sending files on pairing, flashing lights, providing voice functionality, relaying voice to a remote Bluetooth device, detecting connection from a remote Bluetooth device, etc.

The Bluetooth specification (a de facto standard containing information required to ensure that devices supporting Bluetooth can communicate with each other worldwide) defines two transmission ranges for personal area networking. The range is between 10 m and 100 m without a line of sight requirement. The radio link is capable of voice and data transmission up to a maximum capacity of 720 kbps per channel. Any other range can be designed.

A Bluetooth network is completely self organising, and ad hoc personal area networks (PANs) can be established wherever two or more Bluetooth devices are sufficiently close to establish radio contact. Equipment capable of Bluetooth connectivity is able to self-organise by automatically searching within range for other Bluetooth-enabled devices. Upon establishing a contact, information is exchanged which determines if the connection should be completed or not. During this first encounter, the Bluetooth devices connect via a process of authorisation and authentication.

Bluetooth Pairing happens when two Bluetooth enabled devices agree to communicate with one another. When this happens, the two devices join what is can be referred to as a trusted pair. When one device recognizes another device in an established trusted pair, each device automatically accepts communication, bypassing the discovery and authentication process that normally happen during Bluetooth interactions.

When Bluetooth pairing is being set up, the following usually happens:

1. Device A (such as a handheld) searches for other Bluetooth enabled devices in the area.

How does A find these devices? The devices that are found all have a setting that makes them discoverable when other Bluetooth devices search. It's like raising your hand in a classroom: the discoverable devices are announcing their willingness to communicate with other Bluetooth devices. By contrast, many Bluetooth devices can toggle their discoverability settings off. When discoverability is off, the device will not appear when other devices search for it. Undiscoverable devices can still communicate with other Bluetooth devices, but they must initiate all the communications themselves.

2. A detects Device B (such as a second handheld that's discoverable).

During the discovery process, the discoverable devices usually broadcast what they are (such as a printer, a PC, a mobile phone, a handheld, etc.), and their Bluetooth Device Name (such as "Bob's Laptop" or "deskjet995c"). Depending on the device, you may be able to change the Device Name to something more specific. If there are 10 Bluetooth laptops and 5 Bluetooth mobile phones in range, and they are all discoverable, this can come in handy when selecting a specific device.

3. A asks B to send a Passkey or PIN

A passkey (or PIN) is a simple code shared by both devices to prove that both users agree to be part of the trusted pair. With devices that have a user interface, such as handhelds, mobile phones, and PCs, a participant must enter the passkey on the device. With other types of devices, such as printers and hands-free headsets, there is no interface for changing the passkey on the device, so the passkey is always the same (hard coded). A passkey used on most Bluetooth headsets is "0000". The passkeys from both parties must match.

4. A sends the passkey to B

Once you've entered the passkey on A, it sends that passkey to B for comparison. If B is an advanced device that needs the user to enter the same passkey, it will ask for the passkey. If not, it will simply use its standard, unchanging passkey.

5. B sends passkey back to A

If all goes well, and B's passkey is the same entered by A, a trusted pair is formed. This happens automatically when the passkeys agree. Once a trusted pair is developed, communication between the two devices should be relatively seamless, and shouldn't require the standard authentication process that occurs between two devices who are strangers. Embodiments of the present inventions take advantage of the reduced power requirements of certain Bluetooth modes following pairing of two Bluetooth enabled devices.

Bluetooth has several types:

i) Class 2: a class 2 Bluetooth transceiver can discover pair and communicate with any Bluetooth transceiver within a radius of 10 meters seamlessly.

ii) Class 1: A class 1 Bluetooth transceiver can discover pair and communicate with any Bluetooth transceiver within a radius of 100 meters.

iii) Class 3: A class 3 Bluetooth transceiver can discover pair and communicate with any Bluetooth transceiver within a radius of 2 meters.

iv) Non standard devices: can be designed to discover pair and communicate with any Bluetooth transceiver within any distance less than 300 meters.

Power store 24 provides power to some of the components of loss prevention alarm 10. Power store 24 can be a capacitor, a battery (fuel cell, nickel-cadmium, lithium, lithium polymer, lithium ion, alkaline or nickel-hydride battery or any other portable source of electric power) or a combination of a capacitor and a battery, whereby the capacitor onboard a main unit is used to power Bluetooth system 20 for a number of utilizations and it can be charged from time to time by attaching the main unit to a detachable battery unit. Power store 24 can also be replaced with photovoltaic cells, a rechargeable battery, or a battery rechargeable from a distance (such as by induction). When loss prevention alarm 10 is not in operation it remains in a dormant state ("sleep-mode") to conserve the energy of power store 24. For example, small 1.5 volt batteries, and the like, such as those used in small devices like hearing aids, calculators and watches are widely available and can be used as for a power source. One of ordinary skill in the art can readily determine the battery size and power requirements for different embodiments of the present inventions. It is envisioned that other low power specifications can be used in connection with the present inventions. For example, an ultra-low-power wireless technology called Wibree has been developed. Wibree addresses devices with very low battery capacity and can be easily integrated with Bluetooth technology.

Visual indication center 16 comprises one or more LED. The LED can turn on and off periodically to indicate the system is on. The color and frequency of the LEDs can indicate different events such as normal mode, pairing mode, alarm mode, low battery mode, voice mode, etc In a preferred embodiment, visual indication center 16 while indicating the status of the system also illuminates a customizable face plate, made out of clear material such as acrylic. A logo or graphic can be printed on the face plate thus allowing to easily and economically change the look and branding of the device. This automatically leverages the visual indication center, and adds a promotional value and function to the device, above and beyond the main loss prevention function.

In another embodiment, a business method consists of building a marketing campaign centered around an innovative product. In this case, loss prevention alarm 10/11/12 are part of a promotional campaign based on the safety and security theme. Such promotional campaign would give away to customers some branded loss prevention alarm 10/11/12 units. This serves the value of building relationship with customers, reinforcing image, reducing churn and providing customers with a sticky application, that of security for their mobile/laptop devices and data. The customers use the sticky application for a long time, and at the same time, the logo will be flashed.

In another embodiment, visual indication center 16 can be an LCD or any other indication means, and alarm center 25 includes an alarm audible from a distance greater than 6 feet. A regular alarm is between 65 and 120 decibels at 10 feet. Noise levels above 85 decibels can harm hearing over time. Noise levels above 140 decibels can cause damage to hearing after just one exposure. In a preferred embodiment, alarm center 25 has more than 50 decibels or 50 dBA at 10 feet or exceeds ambient sound level by 5 decibels minimum. In a preferred embodiment, the alarm provides an audible signal of at least 60 decibels to notify the user of a designated event, such as a monitored child leaving a desired proximity. The human ear does not respond equally to all frequencies: humans are much more sensitive to sounds in the frequency range about 1 kHz to 4 kHz (1000 to 4000 vibrations per second) than to very low or high frequency sounds. Sound meters are usually fitted with a filter that has a frequency response similar to the human ear. If the "A weighting filter" is used, the sound pressure level is given in units of dB(A) or dBA. In residential areas, most noise comes from transportation, construction, industrial, and human and animal sources. Road traffic noise is the leading source of community noise. The noise can be highly variable. It is common that Day-Night sound levels in different areas vary over a range of 50 dB. The outdoor level in a wilderness area may occur as low as 30 to 40 dBA, and as high as 85-90 dBA in an urban area. Most urban dwellers lives in areas of noise level more than 48 dBA.

Alarm center 25 can be any type of audio, video, tactile or mechanical user interface means capable of conveying information to the user. Audio means can be any audio device such as a speaker, a buzzer, a Piezo buzzer, omni-directional speaker, directional speaker, an ultrasound or any other audio device. Visual means can be an LED, or any visual information display device. Tactile means can be any tactile sensor such as a vibrator, or a heat-generating device.

Antenna 14 can be any type of antenna including chip antenna, patch antenna, PCB antenna and dipole antennas.

In an embodiment, portable loss prevention alarm 10 can be inserted beneath the skin of a human or animal or included inside the housing of objects such as portable computers. In an embodiment, alarm 10 is contained within a capsule formed of an implant-grade material that has minimal risk for rejection by mammalian immune systems and the capsule inserted under the skin. It can also be carried as a keychain or attached to people, animals or objects through a hook, harness, notebook security lock, insert, pin, clip, badge, clip, key chain, ring, tee, dog collar, Velcro fastener, ring, fastening mechanism, sticky or adhesive surface or any other attachment mechanism. Many notebook computers have a security slot on the side, which can be utilized by inserting a notebook security lock; the lock can be attached to an external device, such as a cable or desktop securing mechanism.

Portable loss prevention alarm 10 can also be encased in waterproof packaging and attached to clothes. The packaging can also be shock or impact resistant. System 10 can be incorporated in any other plastic or portable electronic device or object, including for example a cell phone, PDA, a wireless email device, an instant messaging device or pager, a portable computer, an MP3 player, a portable music player, a portable radio device, or any portable electronic device. Alarm 10 can also be sewn into clothes. Preferably, system 10 is as small as is practical so as to avoid distracting or annoying the person or animal carrying it. In an embodiment, the present invention includes clothing that has at least one pocket for holding the remote proximity sensor; the pocket has a closure that can be repeatedly opened and closed to operate the device and/or to remove it for other uses and/or users. Preferably, alarm 10 has dimensions of less than 10 cm×10 cm×5 cm (otherwise stated as "10×10×10 cm") and is less than 200 g in weight. In an embodiment, there are no manually operated controls (e.g, off-on or activation button is magnetically operated, so the housing is not provided with button or switch access), and the device may not have a display. In an embodiment, the housing of the device includes at least one seal and/or is waterproof so that immersion in water, or preferably even running the device through laundering machines, does not damage the electronic components. In a preferred embodiment, system 10 has a size equal to or smaller than 5 cm×3 cm×1.5 cm or 22.5 cubic centimeters ("cc"). A device having the desired functions of the present inventions can fit all of its components into a volume less than 1000 cc, preferably less than about 56 cc, 22.5 cc, and even 10 cc. Each mobile proximity sensor or remote sensor weighs less than 200 grams, preferably less than 50 g, and even less than 10 g. A preferred device has no than four manually operated buttons or switches, and preferably has only one manually operated button or activation switch and no more than one display An embodiment of a remote sensor for attachment to or carrying by a person or animal to be monitored has no manually operated controls and no display; such an embodiment would be difficult to disable and particularly durable to operate under robust physical and environmental challenges. Such a device might be carried by soldiers and law enforcement personnel and have a beacon or alarm that is activated should the housing be broken; small children, animals and others that are being monitored would not be able to disable the device without an alarm being given.

Figure 1B:
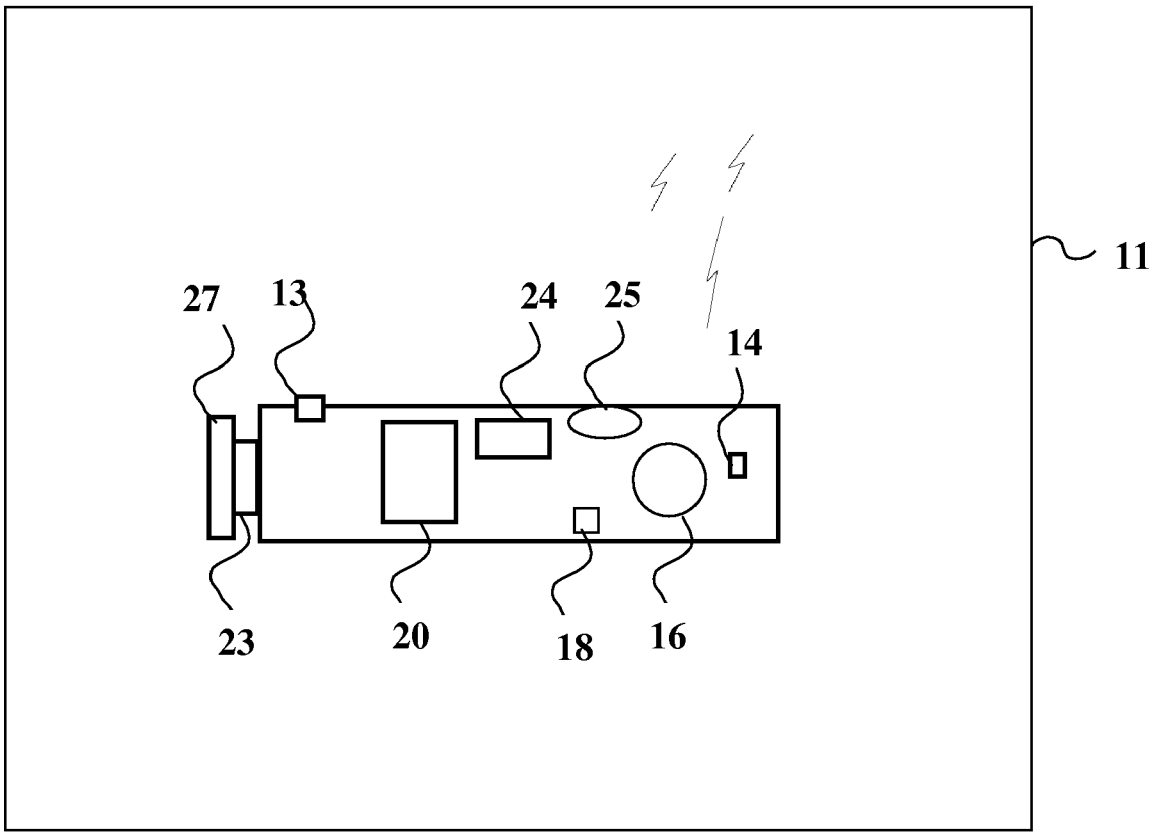
FIG. 1B is a schematic of an alternative portable loss prevention alarm.

FIG. 1B is a schematic of an alternative portable loss prevention alarm 11 comprising a Bluetooth system 20 connected with activation switches 13, visual indication center (or display) 16, power store 24, alarm center 25, antenna 14, Audio center 18, bearing 23 and ear piece 27.

Audio center 18 can be any type of microphone, speaker, earphone wire, etc. In a preferred embodiment, the electronic components of portable loss prevention alarm 11 can be fit into a volume of about 60×30×10 mm or 18 cc or less. For example, portable loss prevention alarm 11 may be fit into a volume less than about 56 cc, 22.5 cc, 18 cc or 10 cc. Ear piece 27 is an earphone or speaker that fits in the ear. Bearing 23 can be a pivot, articulation, U joint or a ball joint. Bearing 23 is generally mounted to ear piece 27 and allows adjusting the angle of ear piece 27 relative to the main body of portable loss prevention alarm 10 across one or more planes.

Figure 1C:
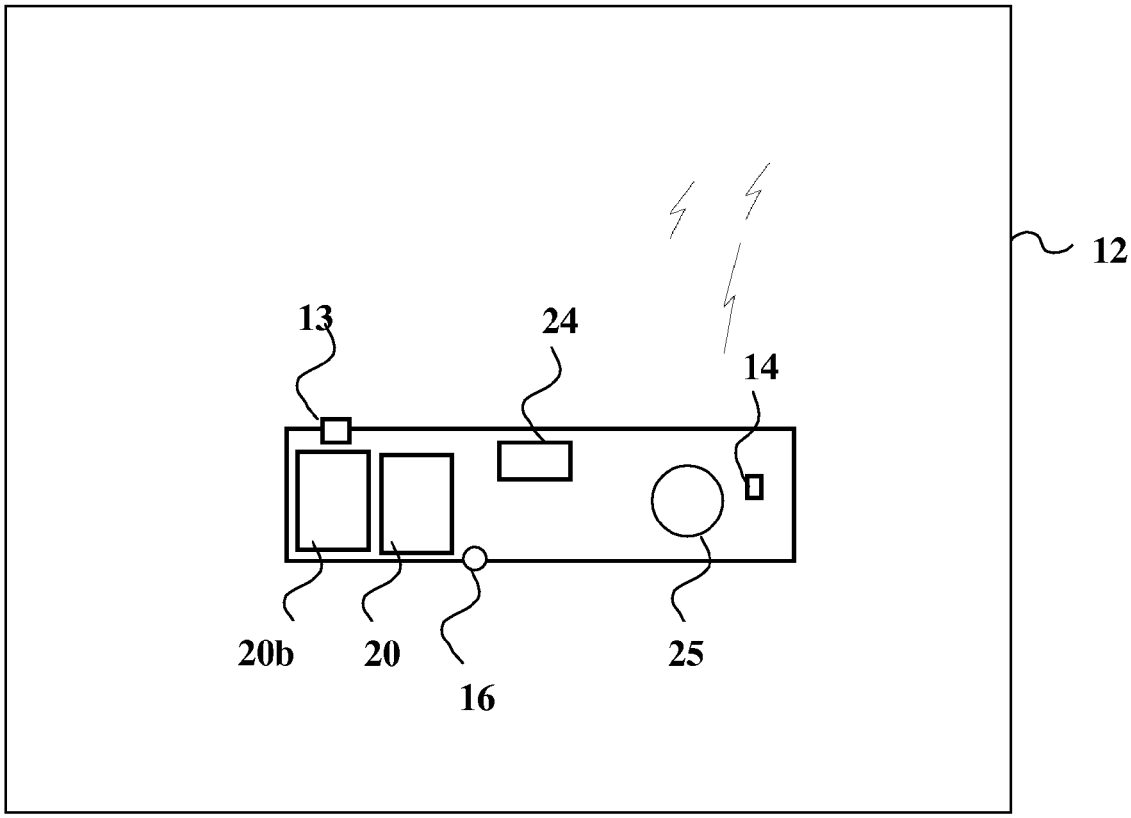
FIG. 1C is a schematic of an alternative portable loss prevention alarm.

FIG. 1C is a schematic of an alternative portable loss prevention alarm 12 comprising a Bluetooth system 20 connected with Bluetooth system 20*b*, activation switches 13, visual indication center (or display) 16, power store 24, alarm center 25 and antenna 14. Bluetooth system 20*b* is similar to Bluetooth system 20, except that it runs a different Bluetooth profile. In a preferred embodiment, Bluetooth system 20*b* runs AGHFP profile.

Figure 2A:
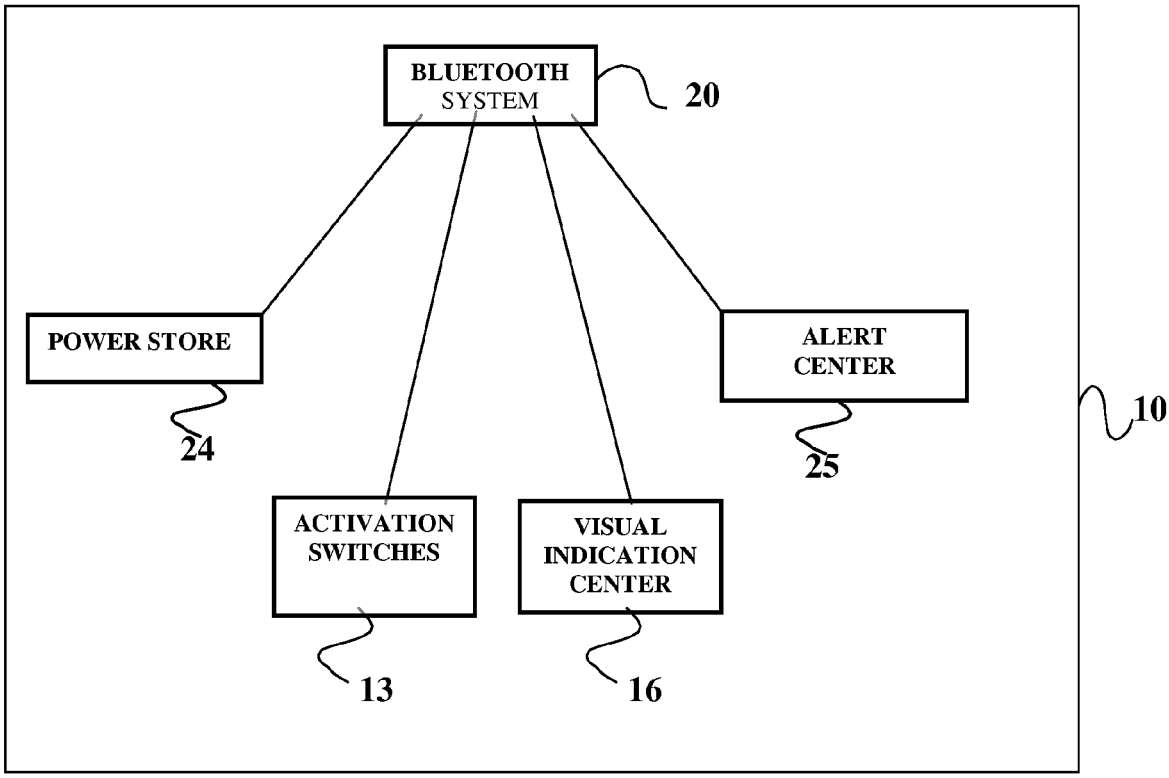
FIG. 2A is a block diagram of portable loss prevention alarm.

Referring to FIG. 2A, in an embodiment, portable loss prevention alarm 10 comprises a Bluetooth system 20 connected with activation switches 13, visual indication center 16, power store 24, and alert (or alarm) center 25.

Figure 2B:
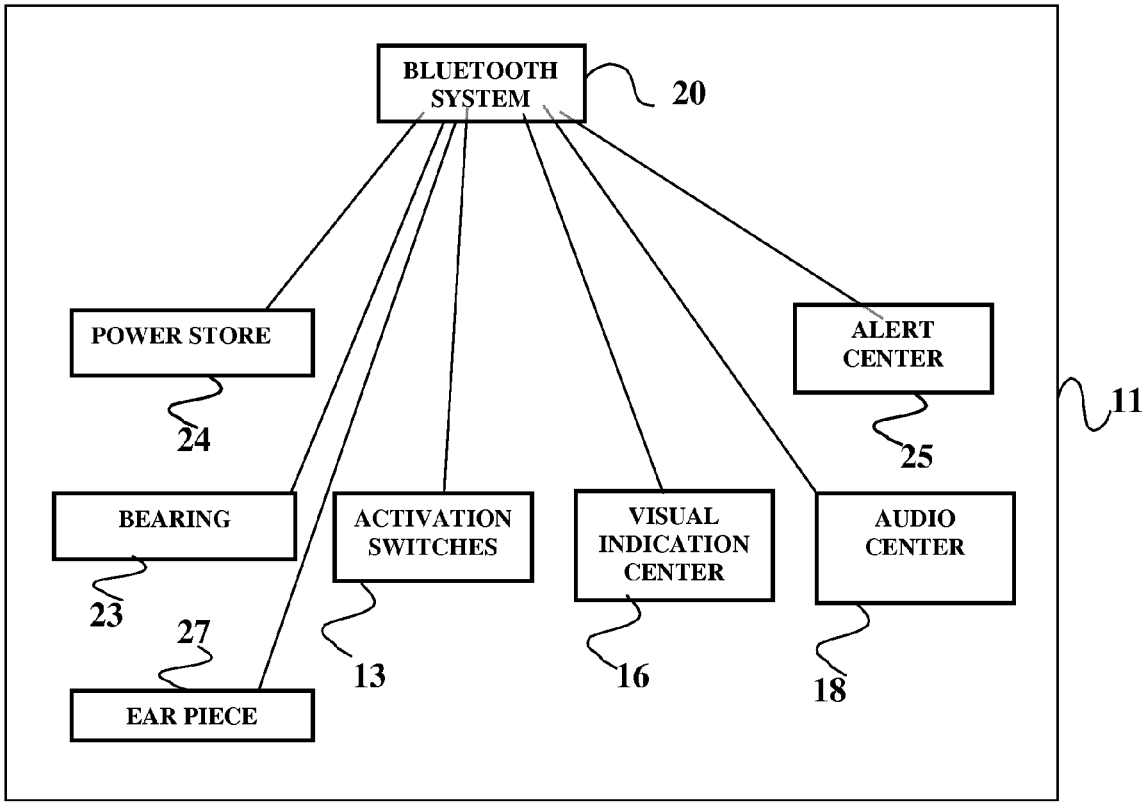
FIG. 2B is a block diagram of an alternative portable loss prevention alarm.

Referring to FIG. 2B, in an embodiment, portable loss prevention alarm 11 comprises a Bluetooth system 20 connected with activation switches 13, visual indication center 16, power store 24, alert center 25, audio center 18, bearing 23 and ear piece 27.

Referring to FIG. 2B, in an embodiment, portable loss prevention alarm 11 comprises a Bluetooth system 20 connected with activation switches 13, visual indication center 16, power store 24, alert center 25, audio center 18, bearing 23 and ear piece 27.

Figure 2C:
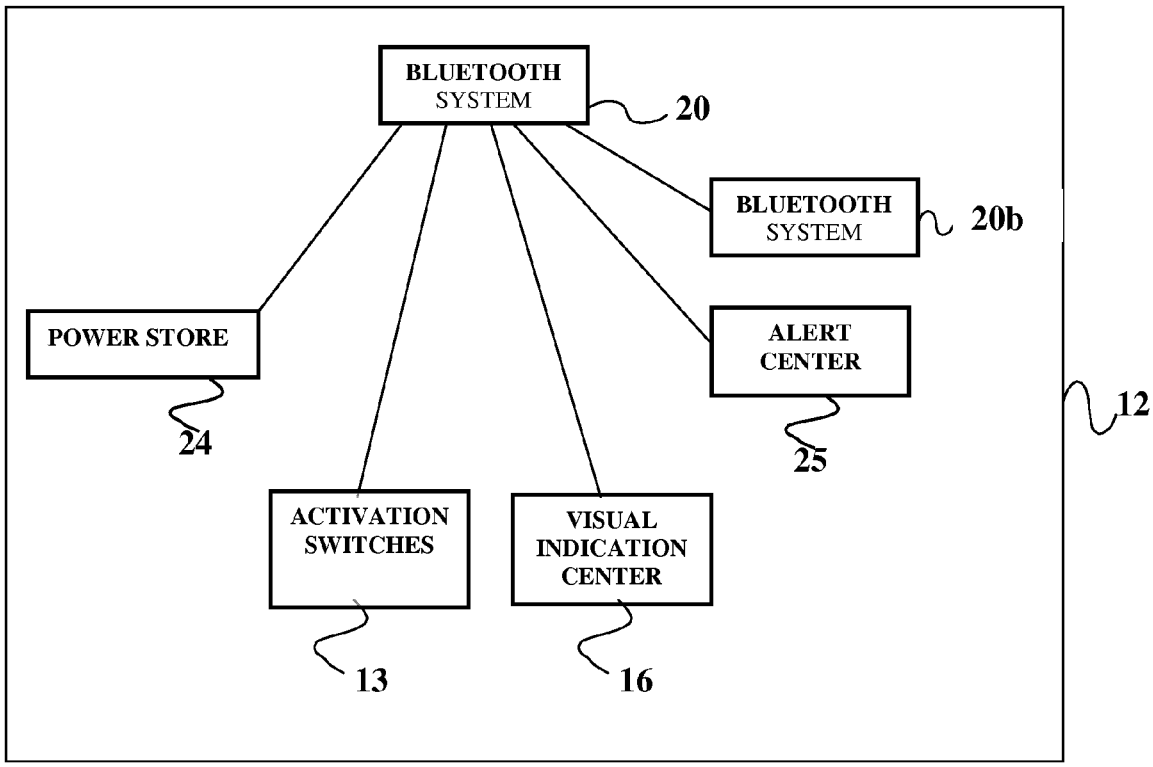
FIG. 2C is a block diagram of an alternative portable loss prevention alarm.

Referring to FIG. 2C, in an embodiment, portable loss prevention alarm 12 comprises a Bluetooth system 20 connected with Bluetooth system 20*b*, activation switches 13, visual indication center 16, power store 24, and alert (or alarm) center 25.

Figure 3A:
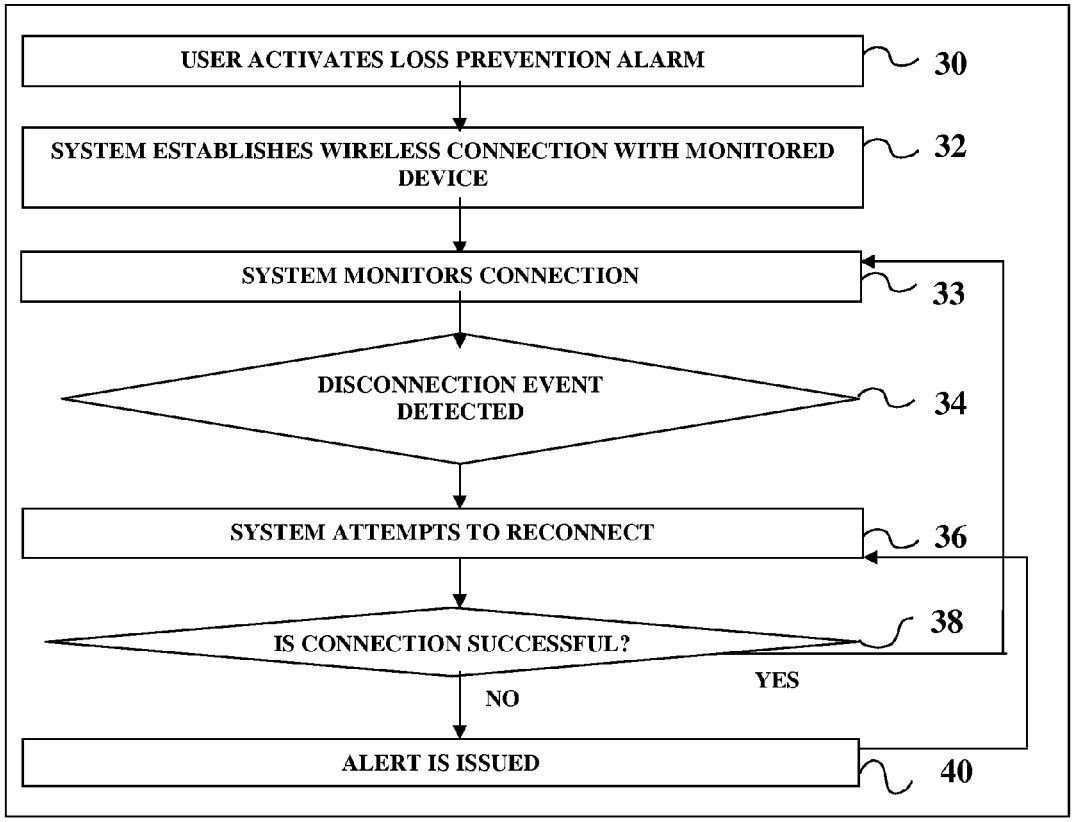
FIG. 3A is a flowchart illustrating the operation of a loss prevention alarm.

Turning now to FIG. 3A, the flowchart illustrates the steps involved in detecting that a portable electronic device (PED) is outside a desired range of a base device (a base device may be referred to as a master and the monitored remote devices referred to as slaves). The PED can be for example a mobile phone, a PDA, a wireless email device, an instant messaging device, a pager, a portable computer, an MP3 player, a portable music player, a portable radio, or any PED. In step 30, the user activates loss prevention alarm 10/11 by pressing activation switch or button 13.

Activation switch 13 has several modes. In a preferred mode, a long press of activation button 13 on the base unit 10 indicates ON/OFF event. A long press may be defined by either the length of time that switch 13 is manually held in a second position against a bias that holds the switch in a first position when at rest, or a signal may be given to indicate that a desired mode of operation or desired action has been initiated. For example, a very long press can cause a switch to pairing mode.

In another embodiment, intermittent button presses can cause a switch to audio mode whereby the device will send and/or receive audio from a second device. In step 32, Bluetooth system 20 in a base unit establishes a Bluetooth connection with a monitored remote device. The wireless connection can be an HSP (headset profile) connection or a HFP (Hands-Free profile) connection. Other connection profiles that can be used include AGHFP (audio gateway HFP), SPP (serial port profile), RFCOMM, A2DP (advanced audio distribution profile), AVRCP (audio video remote control profile), AVCTP (audio video control transport protocol), AVDTP (audio video distribution transport protocol), DUN (dial up networking), and GAVDP (general audio video distribution profile).

In one embodiment, Bluetooth system 20 does not redirect voice calls, thus the mobile phone operations remain intact. Bluetooth system 20 uses a Bluetooth operational mode that uses minimal power, e.g., one of sniff, hold, or park modes. In a preferred embodiment, only Bluetooth sniff mode is used after pairing to assure low power usage and optimize convenience to the user by reducing the frequency of battery recharging or replacement.

In sniff mode, a device listens only periodically during specific sniff slots, but retains synchronization with the paired Bluetooth device onboard the monitored device. In other embodiments, Bluetooth system 20 can use hold mode wherein a device listens only to determine if it should become active, or park mode wherein a device transmits its address. Sniff mode assures very low power consumption and thus extends battery life. In sniff mode, a Bluetooth master radio frequency unit (e.g., base) addresses a slave radio frequency unit (e.g., remote), which enables the slave to synchronize to the master by sending poll packets and optionally null packets over an active link, the master being arranged so that receipt of a response from the slave unit to a poll packet is sufficient to maintain the active link. The slave unit does not have to respond to all poll packets. This approach can allow the slave to preserve more (transmit) power by going into a deep sleep mode in which a low power oscillator may be used while still allowing the master unit to detect whether the slave has resynchronized or not (and thus to update a Link Supervision Timer, for example).

Bluetooth Wireless Technology Profiles: In order to use Bluetooth wireless technology, a device must be able to interpret certain Bluetooth profiles. The profiles define the possible applications. Bluetooth profiles are general behaviors through which Bluetooth enabled devices communicate with other devices. Bluetooth technology defines a wide range of profiles that describe many different types of uses.

At a minimum, each profile specification contains information on (1) dependency on other profiles, (2) suggested user interface formats, and (3) specific parts of the Bluetooth protocol stack used by the profile. To perform its task, each profile uses particular options and parameters at each layer of the stack. This may include an outline of the required service record, if appropriate.

Hands-Free Profile (HFP). HFP describes how a device can be used to pair, to connect to an audio gateway such as a mobile phone, and to place and receive calls. A typical application is a Bluetooth headset device or a Bluetooth car kit. Hands-Free Audio Gateway Profile (AGHFP) describes how a gateway device such as a mobile phone can be used to pair, to connect and to send and receive calls to/from a hands-free device. A typical configuration is a mobile phone.

Headset Profile (HSP). The HSP describes how a Bluetooth enabled headset should communicate with a computer or other Bluetooth enabled device such as a mobile phone. When connected and configured, the headset can act as the remote device's audio input and output interface. The HSP relies on SCO for audio and a subset of AT commands from GSM 07.07 for minimal controls including the ability to ring, answer a call, hang up and adjust the volume.

Serial Port Profile (SPP). SPP defines how to set-up virtual serial ports and connect two Bluetooth enabled devices. SPP is based on the ETSI TS07.10 specification and uses the RFCOMM protocol to provide serial-port emulation. SPP provides a wireless replacement for existing RS-232 based serial communications applications and control signals. SPP provides the basis for the DUN, FAX, HSP and LAN profiles. This profile supports a data rate up to 128 kbit/sec. SPP is dependent on GAP.

Object Push Profile (OPP). OPP defines how to push a file to a Bluetooth device.

RFCOMM. The RFCOMM protocol emulates the serial cable line settings and status of an RS-232 serial port and is used for providing serial data transfer. RFCOMM connects to the lower layers of the Bluetooth protocol stack through the L2CAP layer. By providing serial-port emulation, RFCOMM supports legacy serial-port applications while also supporting the OBEX protocol among others. RFCOMM is a subset of the ETSI TS 07.10 standard, along with some Bluetooth-specific adaptations.

Advanced Audio Distribution Profile (A2DP). A2DP describes how stereo quality audio can be streamed from a media source to a sink. The profile defines two roles of an audio source and sink. A typical usage scenario can be considered as the "walkman" class of media player. The audio source would be the music player and the audio sink is the wireless headset. A2DP defines the protocols and procedures that realize distribution of audio content of high-quality in mono or stereo on ACL channels. The term "advanced audio", therefore, should be distinguished from "Bluetooth audio", which indicates distribution of narrow band voice on SCO channels as defined in the baseband specification.

Audio/Video Control Transport Protocol (AVCTP). AVCTP describes the transport mechanisms to exchange messages for controlling A/V devices.

Audio/Video Distribution Transport Protocol (AVDTP). AVDTP defines A/V stream negotiation, establishment and transmission procedures.

Audio/Video Remote Control Profile (AVRCP). AVRCP is designed to provide a standard interface to control TVs, hi-fi equipment, or other A/C equipment to allow a single remote control (or other device) to control all the A/V equipment that a user has access to. It may be used in concert with A2DP or VDP. AVRCP defines how to control characteristics of streaming media. This includes pausing, stopping and starting playback and volume control as well as other types of remote control operations. The AVRCP defines two roles, that of a controller and a target device. The controller is typically considered the remote control device while the target device is the one whose characteristics are being altered. In a "walkman" type media player scenario, the control device may be a headset that allows tracks to be skipped and the target device would be the actual medial player.

This protocol specifies the scope of the AV/C Digital Interface Command Set (AV/C command set, defined by the 1394 trade association) to be applied, realizing simple implementation and easy operability. This protocol adopts the AV/C device model and command format for control messages and those messages are transported by the Audio/Video Control Transport Protocol (AVCTP).

In AVRCP, the controller translates the detected user action to the A/V control signal, and then transmits it to a remote Bluetooth enabled device. The functions available for a conventional infrared remote controller can be realized in this protocol. The remote control described in this protocol is designed specifically for A/V control only.

Dial-up Networking Profile (DUN). DUN provides a standard to access the Internet and other dial-up services over Bluetooth technology. The most common scenario is accessing the Internet from a laptop by dialing up on a mobile phone wirelessly. It is based on SPP and provides for relatively easy conversion of existing products through the many features that it has in common with the existing wired serial protocols for the same task. These include the AT command set specified in ETSI 07.07 and PPP.

Like other profiles built on top of SPP, the virtual serial link created by the lower layers of the Bluetooth protocol stack is transparent to applications using the DUN profile. Thus, the modem driver on the data-terminal device is unaware that it is communicating over Bluetooth technology. The application on the data-terminal device is similarly unaware that it is not connected to the gateway device by a cable. DUN describes two roles, the gateway and terminal devices. The gateway device provides network access for the terminal device. A typical configuration consists of a mobile phone acting as the gateway device for a personal computer acting as the terminal role.

General Audio/Video Distribution Profile (GAVDP). GAVDP provides the basis for A2DP and VDP, the basis of the systems designed for distributing video and audio streams using Bluetooth technology. GAVDP defines two roles, an initiator and an acceptor. In a typical usage scenario, a device such as a "walkman" is used as the initiator and a headset is used as the acceptor. GAVDP specifies signaling transaction procedures between two devices to set up, terminate and reconfigure streaming channels. The streaming parameters and encode/decode features are included in A2DP and VDP which depend on this profile.

In step 33, Bluetooth system 20 monitors the Bluetooth connection automatically. In this step, Bluetooth system 20 is in sniff mode, and power consumption is below 1 mA. A significant benefit of this system is the ability to monitor a connection while keeping power consumption to a very low level. This enables one of ordinary skill in the art to build portable devices in accordance with the present inventions that use small batteries (100-200 mAh), which can last for at least 2 or 3 weeks before being recharged or swapped. In step 34, on detection of connection drop, i.e., disconnection, Bluetooth system 20 attempts to reconnect in step 36. For example, when a connection is dropped while the system is in sleep mode or sniff mode, a Bluetooth system can automatically generate an event indicating connection drop. In the base and/or remote devices of the present invention, upon the Bluetooth system indicating a connection drop either the base and/or the remote will attempt to reconnect to one another or an alarm will be triggered in the base and/or the remote, as illustrated by issuance of an alarm in step 40. For a mobile phone proximity detector, a connection drop is generally due to the distance between Bluetooth system 20 and the mobile phone being too large, an obstacle being between the two devices that is preventing communication, and/or the mobile phone is powered down. One of ordinary skill in the art will understand from the foregoing that the programming of the Bluetooth system can be adjusted to include instructions to reconnect and/or to trigger an alarm in accordance with the present invention. Automatic reconnection minimizes false alarms and makes the systems of the present invention more reliable and easy to use. An exemplary benefit of the automatic reconnect feature is that when a user comes into proximity of the mobile phone from out of range, the alarm automatically shuts off without requiring any additional input from the user.

In an embodiment of the present inventions, the Bluetooth system will generate an indication or message on detection of a connection drop. For example, firmware running on a Bluetooth chipset, or on a virtual machine which in turn runs on a Bluetooth chipset, can receive or capture that disconnect indication or message. The present invention includes programming that instructs one or more responses to a disconnect indication. For example, the program will instruct a reconnection attempt and/or instruct issuance of an alarm. One of ordinary skill in the art can use market available development tools to write programming to perform the desired functions. It has been discovered by the present inventor that the disconnect event indicator is reliable for detecting that a monitored device is outside a desired range. The claimed invention has an automatic reconnect attempt feature, so that upon detection of a disconnect event, reconnection is attempted; this can avoid many false alarms. Preferably, in an embodiment, an alarm instruction is not given until at least one active reconnect attempt is made and fails. Upon the alarm issuing, periodic reconnect efforts are made, and upon reconnection the alarm will not continue. Avoidance of false alarms makes the invention more convenient for the user.

In an embodiment, the automatic reconnection feature enables the user to locate lost keys that are connected to a proximity alarm device of the present inventions. Turning the mobile phone off automatically triggers an alarm on the key chain device and helps one to locate the keys. The human body can block Bluetooth signals; it is believed that the interference of the human body with Bluetooth signals may be due to the Bluetooth signal being close to the resonance frequency of water (the human body is about 70% water). However, the present invention benefits from a surprising discovery that in the "sniff" mode interference from the human body does not generally block the signals enough to undermine the alarm system reliability, which is in contrast to the interference in paging mode. Hence, a Bluetooth system using sniff mode can be relied upon more than for example Bluetooth modes that require data transfer.

Referring again to the Figures, upon a monitored PED leaving a desired proximity Bluetooth system 20 can start a buzzer, a vibrator, or a sound system. Bluetooth system 20 can also activate LEDs. An example of an audible warning message could loudly state "Your phone is no longer in authorized area". In a preferred embodiment, after an alarm is issued in step 40, system 20 regularly attempts to reconnect with the monitored device.

Figure 3B:
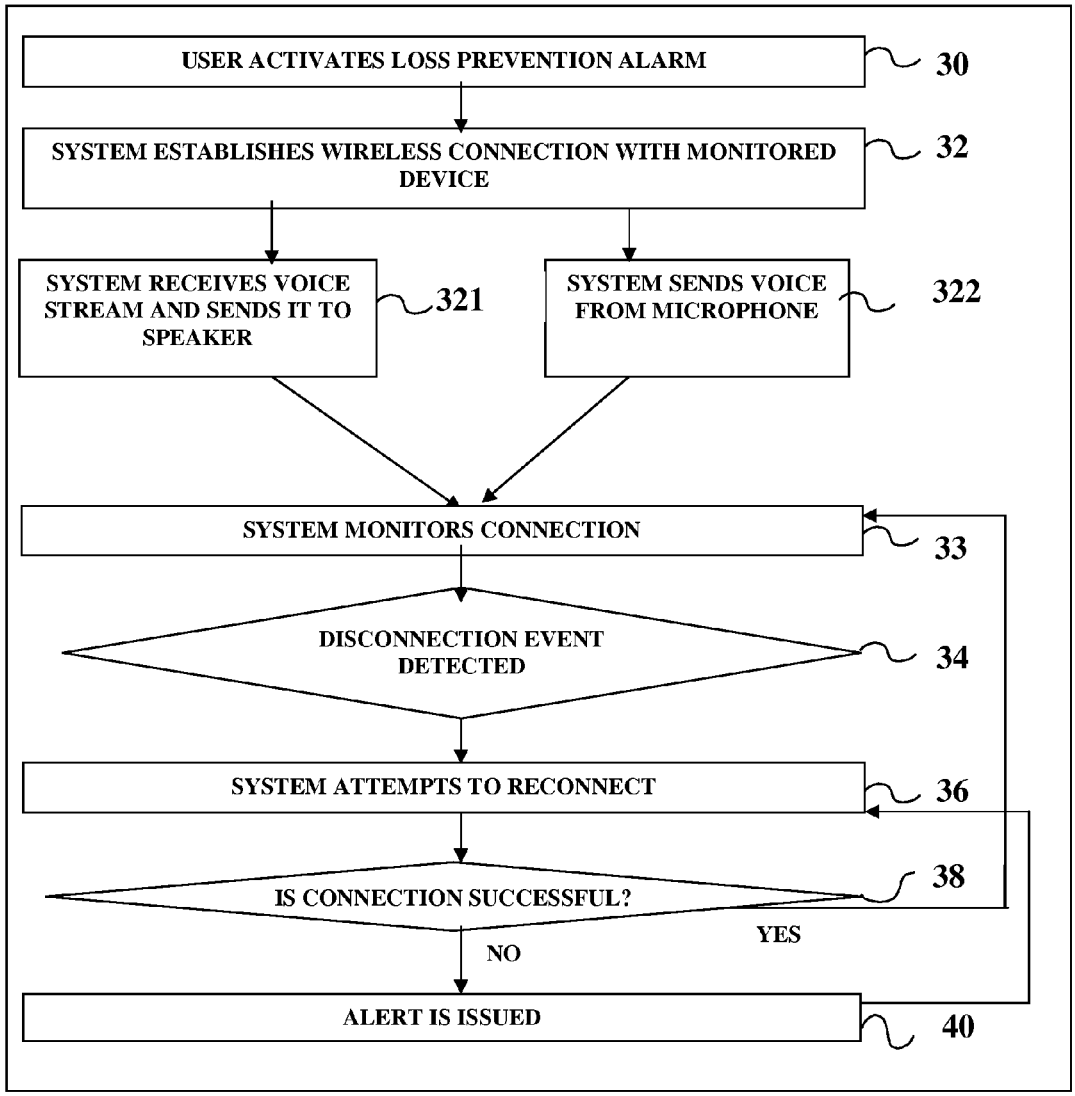
FIG. 3B is a flowchart illustrating an alternative operation of a loss prevention alarm.

Turning now to FIG. 3B, the flowchart illustrates the steps involved in detecting that a portable electronic device is outside a desired range and for transmitting or receiving voice.

Since most people prefer to limit the number of devices they carry, this preferred embodiment allows adding Bluetooth headset functionality to loss prevention alarm 11. When earpiece 27 is folded around bearing 23, the system automatically functions as a Bluetooth headset. When earpiece 27 is unfolded, the system is a flat device that can be carried as a key chain. The system automatically functions as a loss prevention alarm key chain. Earpiece 27 can also pivot around bearing 23 in order to provide better fit and comfort.

This design allows the user:

- To have a quick access to a Bluetooth headset,
- To carry the Bluetooth headset as a keychain,
- Loss prevention alarm alarms when phone is not in proximity,
- To adjust the ear piece for better comfort,
- The ear piece is shielded when not in use by inserting it in a key chain part,
- The keychain can hold several functions such as a USB Flash drive, MP3/MP4 player, recording device, bio sensor, comb, flash light, lighter, home key, car key, Swiss knife, inter alia . . .

Most Bluetooth headsets on the market:

- Do not have a convenient way to carry them, except by attaching them to the ear,
- Have a fixed angle between the ear piece and the main body of the device,
- Have a cover for the ear piece that is small and not practical. It also gets lost easily.

In another embodiment, the microphone comprises an extendable arm. The extendable arm can fold, rotate or slide. This allows for a smaller size for the main part, as well as good microphone voice capture capability.

In another embodiment, the battery is removed from the main body of the device and placed in a second part, such as a lid. This makes the Bluetooth headset lighter and smaller considering that a battery generally accounts for more than 60% of components volume. When inserted into the lid unit, the capacitor onboard the main body recharges.

In step 321 the system receives voice from a second device, and sends it to its onboard speaker. The second device is generally a PED such as a mobile phone. In step 322, the system sends voice from an onboard microphone to a second Bluetooth device.

Figure 3C:
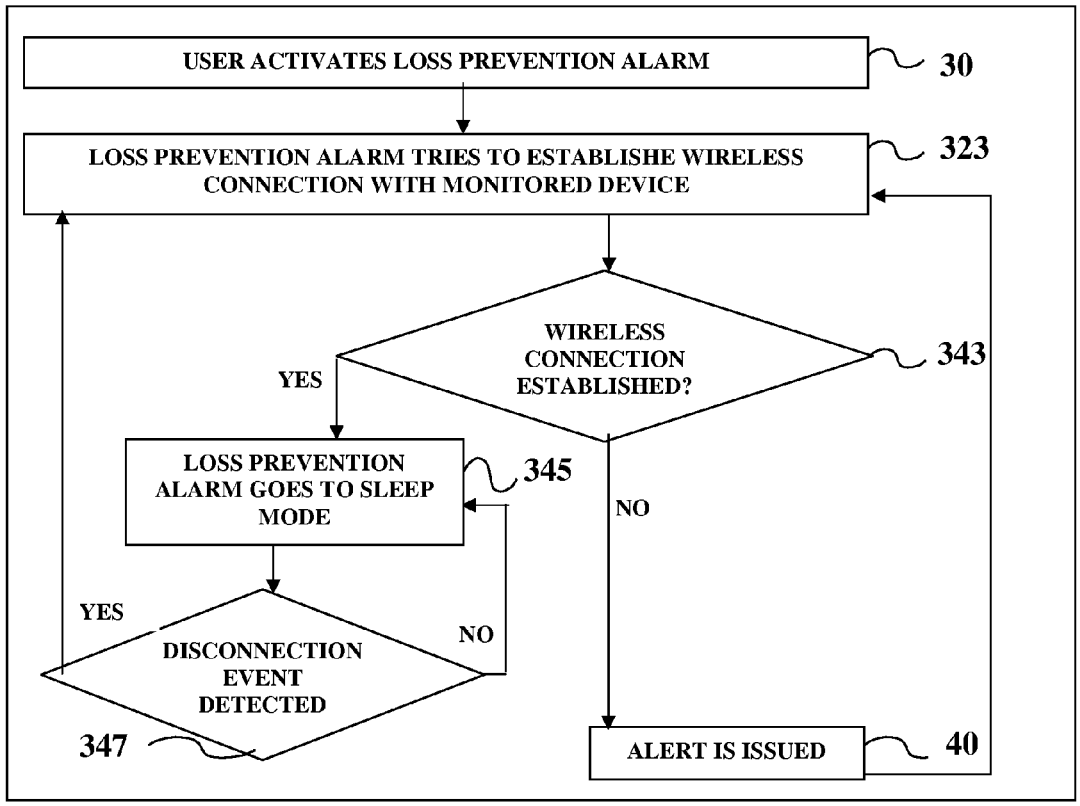
FIG. 3C is a flowchart illustrating operation of a recovery alarm.

Turning now to FIG. 3C, the flowchart illustrates the steps involved in detecting that a portable electronic device has come within desired vicinity. In step 30, the user activates loss prevention alarm 10. In step 323 the system tries to establish wireless connection with a monitored device. In step 343, if a wireless connection is not established. A periodic alert is issued in step 40. The system also periodically tries to reconnect in step 323. If a wireless connection is established in step 343, the system goes to sleep mode in step 345. In step 345, if a disconnection event is detected in step 347, the system automatically tries to re-establish the connection in step 323.

Figure 4A:
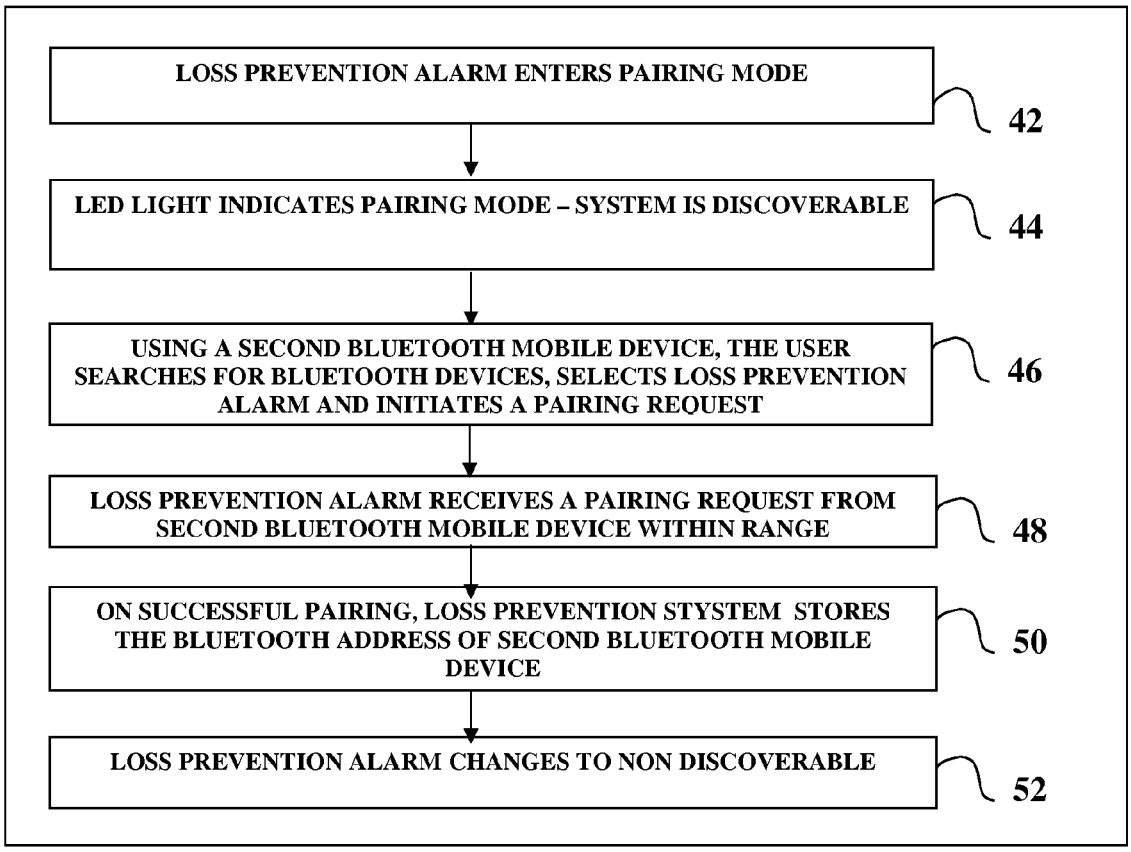
FIG. 4A is a flowchart illustrating initiating the loss prevention alarm.

Turning now to FIG. 4A, the flowchart illustrates the steps involved in initializing the loss prevention alarm. In step 42, loss prevention alarm 10 enters pairing mode. When it is started for the first time, loss prevention alarm 10 will be in pairing mode. The user can also reset the system or force it into pairing mode by pushing activation switch 13 for a sufficiently long duration, or pressing a button a predetermined number of times, to indicate that the user wants to "pair" the loss prevention alarm with a new device to be monitored (i.e., the user makes a "long press"). In step 44, the loss prevention alarm enters pairing mode. Visual indication center 16 can indicate pairing mode using a combination of LED effects, for example, alternating colored LEDs. When Bluetooth system 20 is set to discoverable mode, in accordance with step 46 the user uses a second Bluetooth mobile device to be monitored to search for Bluetooth devices in range and to select the loss prevention alarm from the search list. In a preferred embodiment, the loss prevention alarm appears as a headset to other Bluetooth mobile devices. When the user initiates a pairing request, as shown in step 48, the loss prevention system 10/11 receives a pairing request from the device to be monitored, and requests a PIN code. On successful pairing in step 50, the loss prevention alarm obtains the Bluetooth address of the device to be monitored and stores it in memory as shown by step 52. Bluetooth system 20 changes to non-discoverable mode and visual information center 16 changes to normal mode.

In another embodiment, after pairing, Bluetooth system 20 may send a file to second Bluetooth device using OPP profile. This file can be one or more promotional files such a brochures, music, video, or application software such as a game, a client application, etc.

Figure 4B:
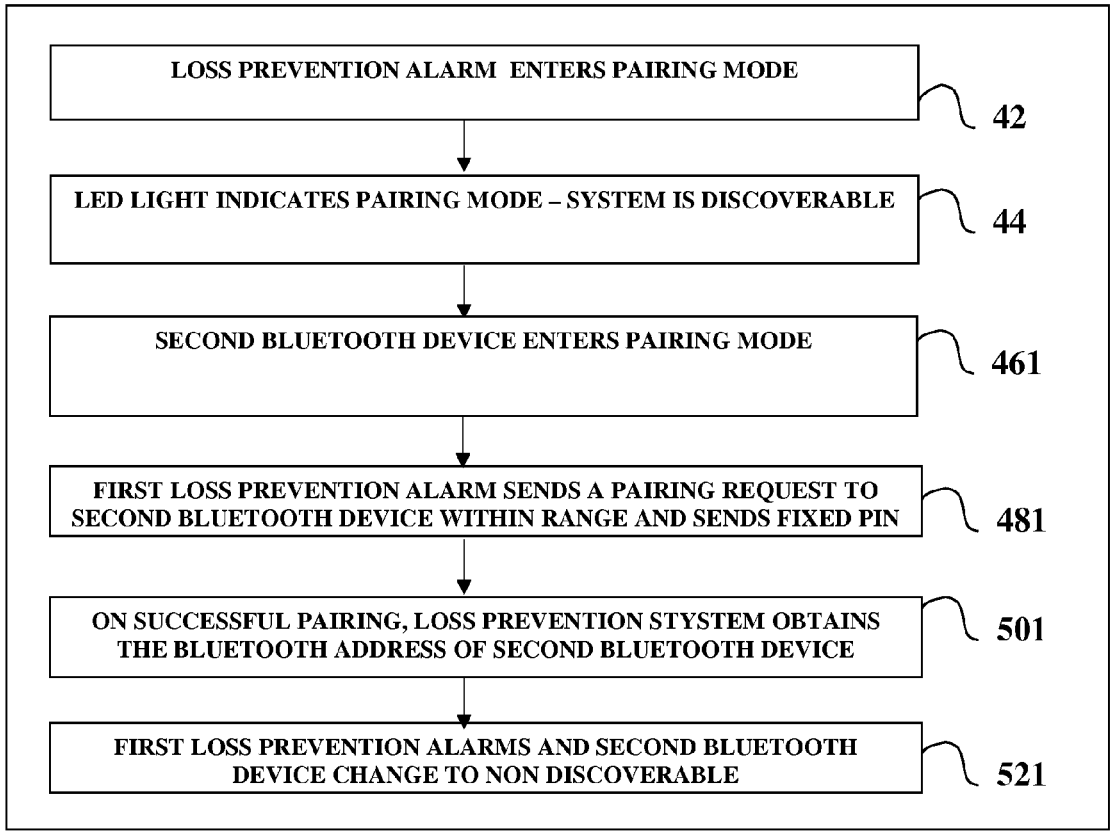
FIG. 4B is a flowchart illustrating initiating the loss prevention alarm with another Bluetooth device.

Turning now to FIG. 4B, the flowchart illustrates the steps involved in initializing the loss prevention alarm. In step 461 the second Bluetooth device enters pairing mode. In step 481, the first loss prevention alarm sends a pairing request and fixed PIN such as "0000" to a second Bluetooth device in range. In step 501, upon successful pairing, the first loss prevention system obtains the Bluetooth address of the second Bluetooth device and stores it. In step 521, the first loss prevention alarm and second Bluetooth device change to non-discoverable mode.

Figure 5:
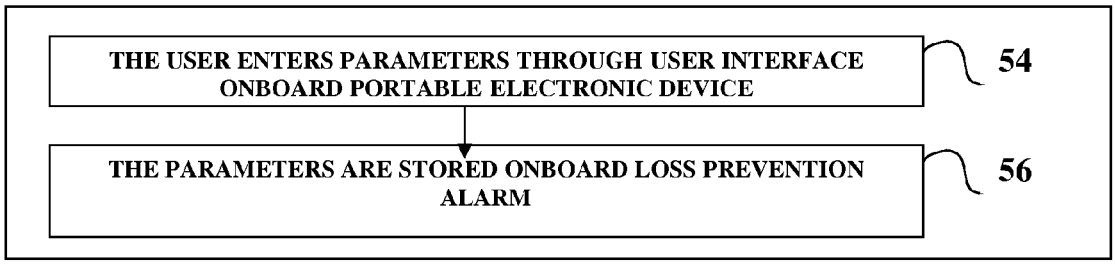
FIG. 5 is a flowchart illustrating configuring the loss prevention alarm.

Turning now to FIG. 5, the flowchart illustrates an alternative embodiment using an application onboard the monitored device. The client application is used to configure the loss prevention alarm 10/11. In step 54 the user views and enters configuration parameters through said application. Configuration parameters may include but are not limited to operation hours, operation days, buzzer type, buzzer volume, buzzer duration, range and alarm type. The configuration parameters are stored onboard the loss prevention alarm in step 56 and can be used to change the properties or to program the loss prevention alarm.

The user may record a voice message that will be broadcast in the event of an alarm, for example, a message containing "Please call xxx xxxx" (where x is a number). The voice message will be stored onboard the loss prevention alarm in step 56. At initialization stage, the loss prevention alarm can install a program on the portable electronic device from a USB flash, a CD, or from other source, such as the Internet. The program can install a user interface or other functionalities on the portable electronic device. For example, the program can allow the portable electronic device to store the address of the loss prevention alarm and to monitor the presence of the loss prevention alarm within range. This will also allow the portable electronic device to issue an alarm when the loss prevention alarm leaves range.

In an alternative embodiment, the loss prevention alarm calculates GPS coordinates and regularly sends them to the application onboard the portable electronic device. In case the connection is dropped, the portable electronic device calculates and displays the direction and distance back to the last known location of the loss prevention alarm.

The loss prevention alarm 10/11 can have several embodiments for each of several applications. In an embodiment, loss prevention alarm 10/11 is attached to or acts as a key chain and can be used as a phone leash. The alarm is triggered when the keychain alarm is at least a predetermined distance from the mobile phone. Therefore, it can prevent the mobile phone from being lost, forgotten or stolen. In this embodiment, the same hardware is used as in a standard Bluetooth headset. However, some components are not needed such as a speaker, microphone, CODEC, and volume buttons. An extra buzzer is used to issue alarms. The system appears to the mobile phone as a headset, however, audio is not redirected from the phone, and thus the phone functionality remains unchanged. On detection of a connection drop, the device periodically attempts to reconnect, and on failure, activates an alarm. In an embodiment, the range of the device is less than about 15 meters or less than about 20 meters.

In another embodiment, loss prevention alarm 10/11 has a PC lock insert that is used to lock the system to the side of a computer laptop or attaches to a laptop carry case. The alarm onboard loss prevention alarm 10 is triggered when the laptop is more than a predetermined distanced from a mobile phone that has a paired Bluetooth system. Therefore, it prevents the laptop from being lost, forgotten or stolen. Preferably the alarm is triggered when the PC and the mobile phone are more than about 5 meters apart.

In another embodiment, a software running on PED consisting of: a Bluetooth profile, a non standard Bluetooth profile or an application running on PED allows establishing a connection with loss prevention alarm 10 and to trigger an alert onboard said PED on connection drop. The alert can be a ring, alert, alarm, video or voice message indicating "Your monitored device is not in your vicinity". A non standard Bluetooth profile is one that is not part of the profiles adopted by the Bluetooth Special Interest Group.

In a preferred embodiment, the software makes efficient use power consumption by controlling Bluetooth sleep modes. It can perform also several other functions including:

Automatically log the user in the operating system security (such a Window password screen, Linux password screen, Internet web site, Internet Web 2.0 account, application access screen . . . ) when loss prevention alarm is in proximity, and automatically log the user out when out of proximity.

Automatically decrypt files onboard PED when the loss prevention alarm is in proximity and encrypt them when PED is outside proximity.

Provide access or privileges to specific files when loss prevention alarm is in proximity.

When a PC or laptop is stolen, a person can install a new copy of Windows and have access to all the files on that system thus bypassing Windows security. Encrypting the data can make it more difficult to access the data when a laptop is stolen.

The Bluetooth ("BT") protocol includes programmable and built-in Security/authentication features and several built-in power usage modes, for example sniff mode has low-power consumption (<0.5 mA), while voice transmission can use more than 20 mA. Bluetooth modules are readily available on the market at a reasonable cost of around US$5 (in 2007). Bluetooth frequency is 2.4 GHz, similar to the frequency used in microwave ovens and close to the resonance frequency of water.

Since the human body is 70% water Bluetooth signals can be distorted and attenuated by a human body. For example, Bluetooth range can drop dramatically when a parent and child each having one of a set of BT communicators in front of them stand back to back. Bluetooth range is not easily adjustable and does not change gradually.

Figure 6:
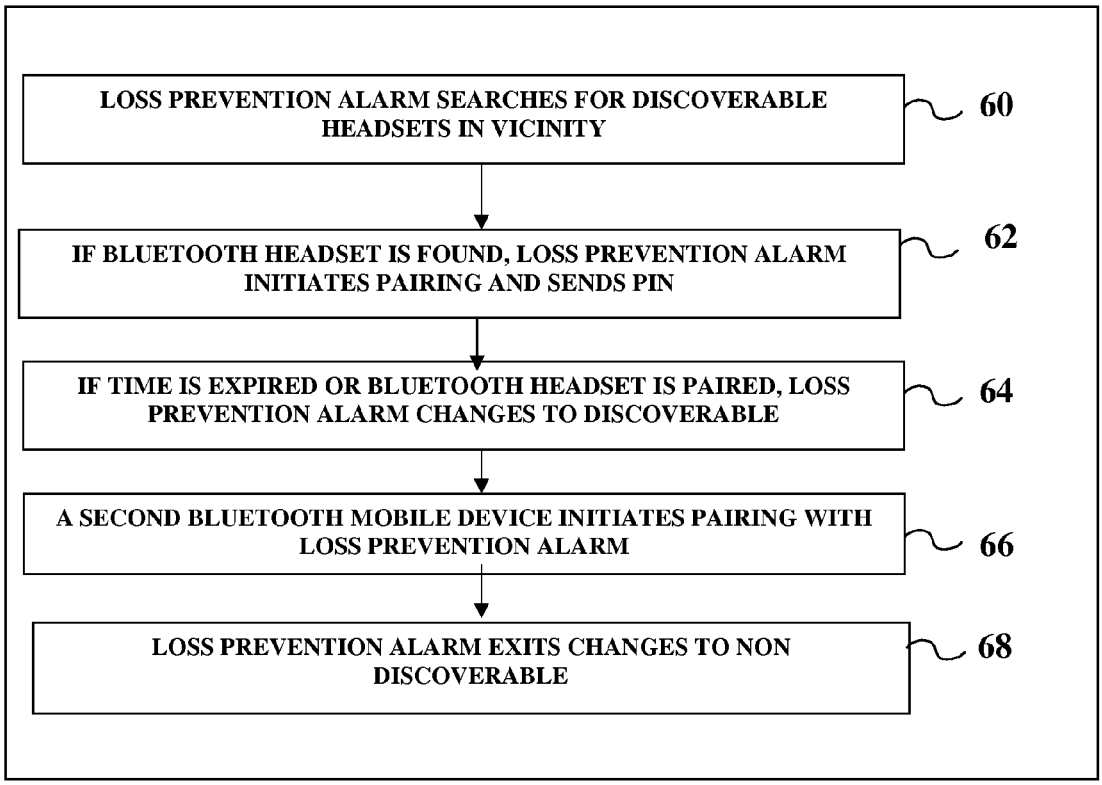
FIG. 6 is a flowchart illustrating pairing portable prevention system with a Bluetooth headset and a Bluetooth mobile device.

Turning now to FIG. 6, the flowchart illustrates pairing portable prevention system with a Bluetooth headset and a Bluetooth mobile device.

Some mobile phones such as Blackberry and iPhone only allow one Bluetooth headset connection to be active at one time when a phone conversation is taking place. The user cannot use a loss prevention alarm device 10/12 emulating HSF/HFP if he/she already uses a Bluetooth headset device with his/her mobile phone. Bluetooth headset is any Bluetooth headset available on the market and capable of providing headset functionality.

In a preferred embodiment, the Bluetooth headset is not paired directly with the PED. Loss prevention alarm 10/12 can automatically pair with one or more of the user's Bluetooth headset by issuing a PIN code of "0000" which is used by a large majority of Bluetooth headsets. When a paired Bluetooth headset device is active, loss prevention alarm switches to a relay mode. In a relay mode, voice streams and commands from PED are sent to/from Bluetooth headset. When the Bluetooth headset is not active, loss prevention alarm 10 monitor proximity of PED, and does not re-direct voice streams.

In step 60, loss prevention alarm 11 runs two Bluetooth profiles, HFP or HSP and AGHFP. It runs AGHFP to search for headsets in the vicinity that are discoverable for a period of time. In step 62, if loss prevention alarm 11 finds one or more discoverable headsets, it initiates pairing and sends PIN code of "0000". In step 64, if the period of time is expired or a discoverable Bluetooth headset is found, loss prevention alarm 11 stops the search, switches to discoverable mode, runs as HFP or HSP and waits for a pairing request from a PED. Loss prevention alarm 11 may pair with multiple headsets/car kits. In step 66, a second Bluetooth PED such as a mobile phone initiates pairing with loss prevention alarm 11. In step 68, loss prevention alarm 11 exits pairing mode and changes to non discoverable.

Figure 7:
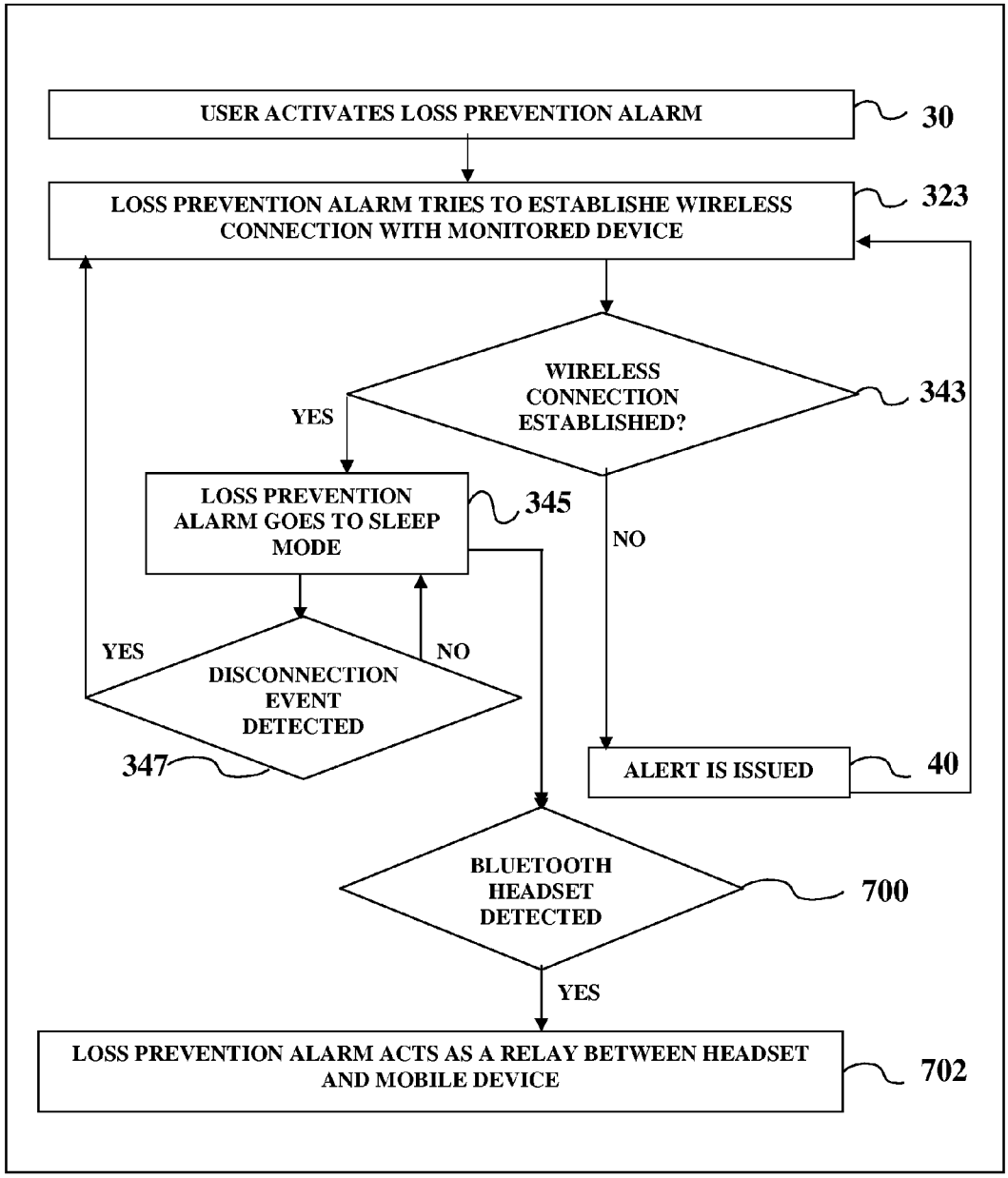
FIG. 7 is a flowchart illustrating the relay operation of a portable loss prevention alarm.

Turning now to FIG. 7, the flowchart illustrates an alternative embodiment whereby loss prevention alarm 10 acts as a relay.

Loss prevention alarm 10 runs HSP/HFP and AGHFP simultaneously on the same Bluetooth system 20. Loss prevention 10 appears to PED as a headset (HSP or HFP) and monitors proximity to it while instructing it not to send or receive voice streams.

If paired with one or more Bluetooth headsets, loss prevention 10 appears to Bluetooth headset as PED. In step 30, user activates loss prevention alarm 10. In step 323, loss prevention alarm 10 tries to establish HSP or HFP connection with monitored device. In step 343, if connection is not established, an alarm is issued and the system tries to reconnect in step 323. If a connection is established, loss prevention alarm 10 goes to sleep mode in step 345. If later a disconnection event is detected, the system tries to reconnect in step 323.

In step 700, if a connection event is detected from a paired Bluetooth headset through AGHFP, loss prevention alarm changes mode and relays voice streams and commands programmatically between paired Bluetooth headset and PED in step 702. Voice streams and commands coming from Bluetooth headset are transferred to PED and voice streams and commands coming from PED are transferred to Bluetooth headset. Detecting connection event from a paired Bluetooth headset is a standard feature of AGHFP profile.

Turning again to FIG. 7, the flowchart illustrates an alternative embodiment whereby loss prevention alarm 12 acts as a relay. Loss prevention alarm 12 has two Bluetooth systems. Bluetooth system 20 runs HSP/HFP and Bluetooth system 20*b* runs AGHFP. In this configuration, Bluetooth system 20 is the controller. The input voice channels from Bluetooth system 20 are physically connected to the output voice channels of Bluetooth system 20*b*, and the output voice channels from Bluetooth system 20 are physically connected to the input voice channels of Bluetooth system 20*b*.

Bluetooth system 20 appears to PED as a headset (HSP/HFP) and monitors proximity to it while instructing it not to send or receive voice streams. It alarm if the link is disconnected.

If paired with a Bluetooth headset, Bluetooth system 20*b* appears to the paired Bluetooth headsets as PED. Bluetooth system 20*b* may be in low power mode such as sniff, park, hold modes. If not paired with a Bluetooth headset, Bluetooth system 20*b* is powered down.

In step 30, the user activates loss prevention alarm 12. In step 323, loss prevention alarm 12 tries to establish HSP/HFP connection with monitored device. In step 343, if connection is not established, and alarm is issued and the system tries to reconnect in step 323. If a connection is established, loss prevention alarm goes to sleep mode in step 345. If later a disconnection event is detected in step 347, the system tries to reconnect in step 323.

In step 700, if Bluetooth system 20*b* is on and it detects a connection event from a paired Bluetooth headset, loss prevention alarm 12 changes to a relay mode in step 702.

First, an indication is sent to Bluetooth system 20. Bluetooth system 20 and PED connect voice streams. Bluetooth system 20*b* and paired Bluetooth headset connect voice streams. Since Bluetooth system 20 and Bluetooth system 20*b* are connected through wiring, voice streams and commands flow between paired Bluetooth headset and PED, through Bluetooth system 20 and Bluetooth system 20*b*.

The details of certain embodiments of the present inventions have been described, which are provided as illustrative examples so as to enable those of ordinary skill in the art to practice the inventions. The summary, figures, abstract and further details provided are not meant to limit the scope of the present inventions, but to be exemplary. Where certain elements of the present inventions can be partially or fully implemented using known components, only those portions of such known components that are necessary for an understanding of the present invention are described, and detailed descriptions of other portions of such known components are omitted so as to avoid obscuring the invention. Further, the present invention encompasses present and future known equivalents to the components referred to herein.

The inventions are capable of other embodiments and of being practiced and carried out in various ways, and as such, those skilled in the art will appreciate that the conception upon which this disclosure is based may readily be utilized as a basis for the designing of other methods and systems for carrying out the several purposes of the present inventions. Therefore, the claims should be regarded as including all equivalent constructions insofar as they do not depart from the spirit and scope of the present invention. The following claims are a part of the detailed description of the invention and should be treated as being included in this specification.

The invention claimed is:

1. A proximity detection alarm device, comprising:

a first unit, said first unit comprising a first Bluetooth system comprising one transceiver;

at least one alarm;

at least one control;

a power input;

an attachment mechanism, an ear piece;

said ear piece operatively connected to the main body of said first unit so that said ear piece can fold against and unfold away from said main body of said first unit;

wherein said device will fit into a space having a volume less than 18 cubic centimeters, wherein said device has a weight less than about 50 grams, and wherein said device consumes less than 50 mAh, wherein said first Bluetooth system can pair with a second Bluetooth system in a first range, wherein said attachment mechanism is selected from the group consisting of a key chain, a ring, a hook, a notebook security lock, an insert, a pin, a clip, a tee, a collar, Velcro fastener, a ring, a wire, a case, a badge and a sticky surface, wherein said transceiver of said first Bluetooth system is selected from the group consisting of class 1, class 2, class 3, and Wibree, wherein said first Bluetooth system is set to use a profile selected from the group consisting of HFP profile, HSP profile, HID profile, AGHFP profile, A2DP profile, and SPP profile, wherein following connection with a second Bluetooth system, said first Bluetooth system will utilize a power saving mode, wherein said at least one control comprises at least one of the group consisting of a button, a switch, and a sensor, wherein said at least one alarm is audible and when activated produces an alarm signal of at least 60 decibels, wherein upon said first Bluetooth system detecting a connection drop from a second Bluetooth system to which said first Bluetooth system has formed a pair, said first Bluetooth system will periodically attempt to reconnect to the second Bluetooth system, wherein said alarm will be activated within a predetermined time after a connection drop between said first Bluetooth system and a second Bluetooth system to which said first Bluetooth system has formed a pair, wherein when folded said proximity detection alarm device functions as a Bluetooth headset, and when unfolded said proximity detection alarm device activates said alarm upon a disconnection for the predetermined time.

2. The proximity detection alarm device of claim 1 further comprising a logo wherein said logo illuminates periodically.

3. The proximity detection alarm device of claim 1, wherein following pairing with a portable electronic device, said first Bluetooth system will use object push profile to send a file from flash memory to said second Bluetooth system, wherein said file is selected from the group consisting of a java application, an image, and a video.

4. A proximity detection alarm device, comprising:

a first unit, said first unit comprising a first Bluetooth system with one transceiver;

at least one control;

a power input;

a microphone;

an ear piece;

a bearing joining said ear piece to the main body of said first unit;

wherein said ear piece can fold and unfold, wherein upon said first Bluetooth system detecting a connection drop from a second Bluetooth system to which said first Bluetooth system has formed a pair, said first Bluetooth system will periodically attempt to reconnect to the second Bluetooth system, wherein an alarm will be activated within a predetermined time after a connection drop between said first Bluetooth system and a second Bluetooth system to which said first Bluetooth system has formed a pair, and wherein said ear piece can be folded and aligned with said main body, and wherein on folding said ear piece, said proximity detection alarm device functions as a Bluetooth headset.

5. The proximity detection alarm device of claim 4 further comprising a device selected from the group consisting of: USB Flash drive, MP3/MP4 player, recording device, bio sensor, comb, flash light, lighter, key and knife.

6. The proximity detection alarm device of claim 4 wherein:

when unfolded said proximity detection alarm device alarms on disconnect, when a request for action is received and the action is selected from the group consisting of user authentication, user log in, file decrypt, and access grant, said proximity detection alarm device sends a reply.

* * * * *